US008179256B2

(12) United States Patent
Crisp et al.

(10) Patent No.: US 8,179,256 B2
(45) Date of Patent: May 15, 2012

(54) SERVER BASED DISTRIBUTED SECURITY SYSTEM

(75) Inventors: Martin Crisp, North Lanarkshire (GB); Robert John Probin, South Lanarkshire (GB); Mark Hosey, South Lanarkshire (GB)

(73) Assignee: Honeywell International Inc., Morristown, NJ (US)

( * ) Notice: Subject to any disclaimer, the term of this patent is extended or adjusted under 35 U.S.C. 154(b) by 509 days.

(21) Appl. No.: 12/125,529

(22) Filed: May 22, 2008

(65) Prior Publication Data

US 2009/0322527 A1 Dec. 31, 2009

(51) Int. Cl.
*G08B 13/00* (2006.01)

(52) U.S. Cl. ..... 340/541; 340/565

(58) Field of Classification Search ..... 340/541, 340/551, 552, 561, 565, 566
See application file for complete search history.

(56) References Cited

U.S. PATENT DOCUMENTS 6,741,171 B2 * 5/2004 Palka et al. ..... 340/501
7,085,551 B1 8/2006 Bonner et al.
7,263,073 B2 * 8/2007 Petite et al. ..... 370/278
7,409,045 B2 * 8/2008 Naidoo et al. ..... 379/37
7,679,507 B2 * 3/2010 Babich et al. ..... 340/539.16
2008/0122575 A1 * 5/2008 Lavian et al. ..... 340/3.1

FOREIGN PATENT DOCUMENTS

WO WO 2008/041214 4/2008

OTHER PUBLICATIONS

European Patent Office Search Report, mailed Jun. 7, 2009 corresponding to International application No. 09160447.0-1232.
Cisco Systems: "Alarm Interface Controller Network Module for the Cisco 2600 and 3600 Series" Datasheet Cisco, Jan. 1, 2005, pp. 1-13, XP007908965.

* cited by examiner

*Primary Examiner* — Toan N Pham
(74) *Attorney, Agent, or Firm* — Husch Blackwell

(57) ABSTRACT

A security system including one or more sensors for detecting a predetermined security event. One or more communications modules include a transmitting device for communicating with the sensor and transmitting an alert signal of the security event. A remotely located computer system controls the communications between the transmitting device of the communication module for receiving a signal from and transmitting to the communications module. After receiving the alert signal, the computer system communicates an alarm signal.

17 Claims, 1 Drawing Sheet

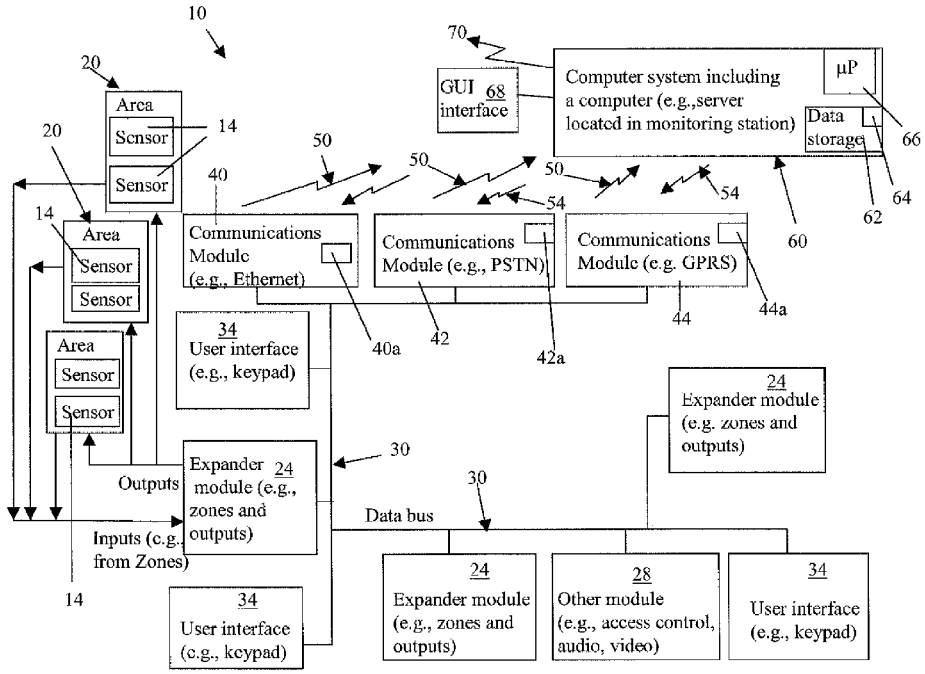

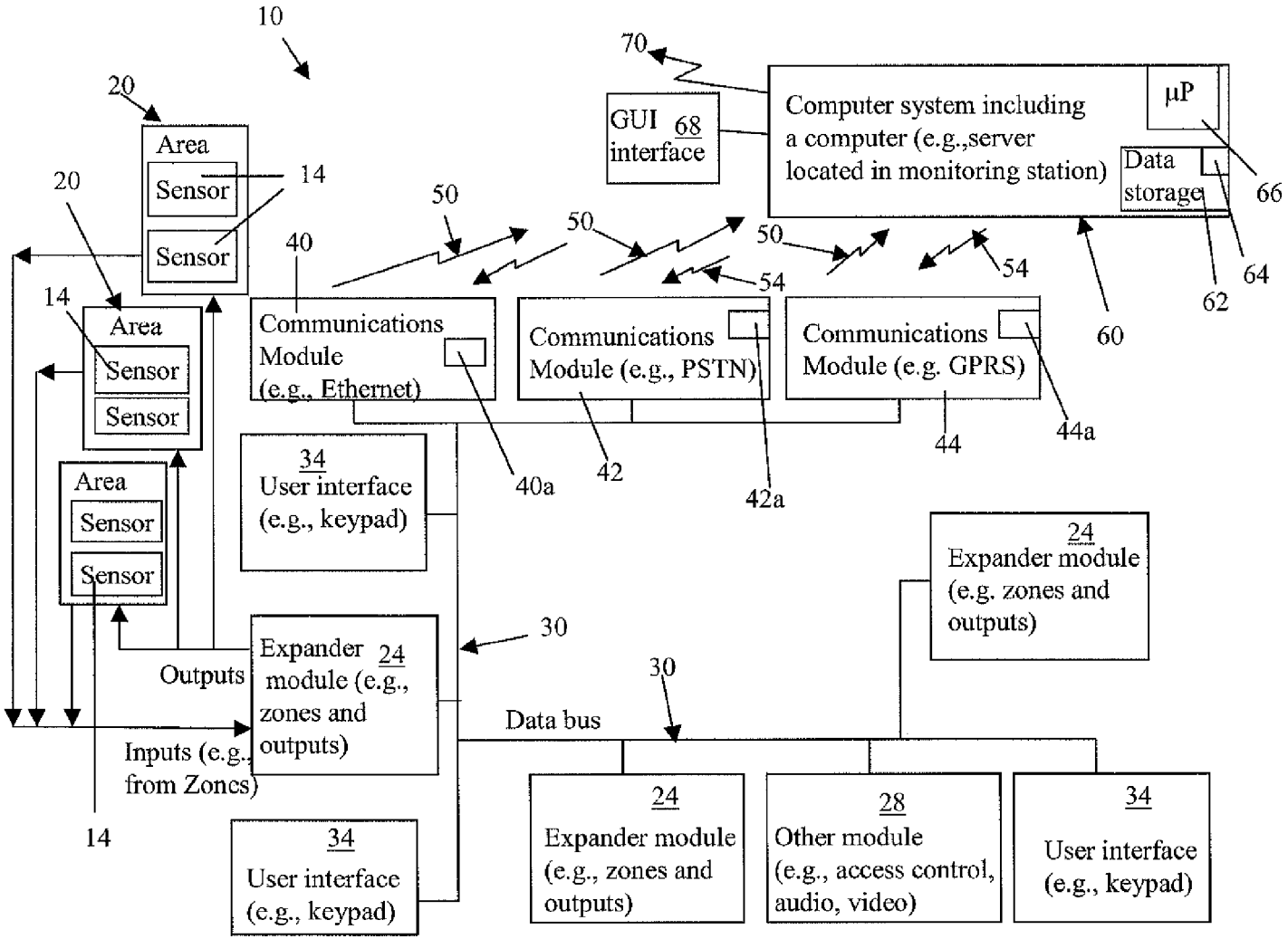
10
70
GUI 68 interface
Computer system including a computer (e.g.,server located in monitoring station)
μP
Data storage
66
64
62
60
50
54
Communications Module (e.g., Ethernet)
40
40a
Communications Module (e.g., PSTN)
42
42a
Communications Module (e.g. GPRS)
44
44a
Area
Sensor
Sensor
14
20
Area
Sensor
Sensor
14
20
Area
Sensor
Sensor
14
34 User interface (e.g., keypad)
Expander 24 module (e.g., zones and outputs)
Outputs
Inputs (e.g., from Zones)
30
Data bus
24 Expander module (e.g. zones and outputs)
34 User interface (e.g., keypad)
28 Other module (e.g., access control, audio, video)
24 Expander module (e.g., zones and outputs)
34 User interface (e.g., keypad)

SERVER BASED DISTRIBUTED SECURITY SYSTEM

CROSS REFERENCE TO RELATED APPLICATION

This application is related to commonly-owned, co-pending U.S. patent application Ser. No. 12/130,200 filed on May 30, 2008, the entire contents and disclosure of which is expressly incorporated by reference in its entirety.

FIELD OF THE INVENTION

The present invention relates to a security system and method for remotely monitoring a specified area, and more particularly, a security system and method including a computer system for remotely monitoring a specified area using a sensor.

BACKGROUND OF THE INVENTION

Typical currently known security systems generally include an on site control device such as a control panel. The control panel may include a microprocessor with software or firmware designed for monitoring one or more sensors designated to specified areas. The sensors may be divided into security zones which are all monitored by the central control panel. The control panel is a significant cost of the security system. The security system, including the control panel, requires installation, inspections, maintenance, repairs, and upgrades. The control panel hardware can be expensive and the installation requires the time of a skilled technician. Further, when updating the software or firmware, a technician has to visit the site where the security system and control panel are located, which is costly and time consuming. Additionally, it is possible that upgrading the security system requires additional hardware or changing hardware to enable new features or functions, which can be costly and require the time of a skilled technician. Further, a supplier and/or warehouse may have to stock large quantities of various panel types to meet demand, thus incurring cost.

It would therefore be desirable to eliminate the need for maintenance personnel, e.g., technicians, to monitor, inspect, repair, and upgrade on-site control devices or control panels of security system thereby reducing the overall time a technician need to spend on-site. It would also be desirable to have a security system or method which did not require the installation of a control panel. It would further be desirable for the control device or control panel of the security system to be located remotely and require low installation costs.

SUMMARY OF THE INVENTION

In an aspect of the invention, a security system includes at least one sensor for detecting a predetermined security event in a defined area. A communications module includes a transmitting device, and the communications module communicates with the sensor and the transmitting device for transmitting an alert signal of the security event using a communications system. A remotely located computer system outside the defined area and communicating with the communications module using the communications system. The computer system controls the communications between the transmitting device of the communications module and the computer system for receiving transmissions from and sending transmissions to the communications module. The computer system communicates an alarm signal after receiving the alert signal.

In a related aspect, the computer system communicates with multiple communication systems for communicating with associated communication modules. The computer system may communicate with multiple communication systems for receiving the alert signal from the communications module and for transmitting to the communications module. Further, the computer system may communicate simultaneously with multiple communication systems for receiving the alert signal from associated communication modules using each of the multiple communication paths, and the computer system may use each of the multiple communication systems for transmitting to each of the associated communication modules. Further, the communication module may communicate with a plurality of detection areas and each detection area includes a plurality of sensor devices. The computer system may include a computer program embodied on computer readable medium executable by a microprocessor in the computer system, and the computer program may logically generate security zones, and each security zone includes a plurality of associated sensor devices. The computer system may present a graphic interface on a GUI interface wherein the graphic interface presents representation for each of the security zones. The system may further include multiple communication modules. The multiple communication modules may each connect to a data bus communicating with security areas including multiple sensors. The alert signal may be wirelessly transmitted, and the transmission of the alert signal may be encrypted. The computer system may be remotely located at a monitoring station.

In another aspect of the invention, a method for securing a specified area, comprising: detecting a predetermined security event using a sensor in a specified area; communicating with the sensor and a transmitting device using a communications module; transmitting an alert signal of the security event using the communications module and a communications system; receiving the alert signal using a remotely located computer system outside the specified area; sending data to the communications module using the computer system via the communications system; and communicating an alarm signal using the computer system after receiving the alert signal.

In a related aspect, the method further includes communicating simultaneously with multiple communication systems using the computer system. The method may further include generating logically a plurality of security zones each associated with a plurality of sensor devices using the computer system. Additionally, the method may further include presenting a graphic interface on a GUI interface wherein the graphic interface presents representation for each of a plurality of security zones.

In another aspect of the invention, a computer program product comprises a computer readable medium having recorded thereon a computer program for enabling a processor in a computer system for securing a specified area, the computer program performs the steps of: detecting a predetermined security event using a sensor in a specified area; communicating with the sensor and a transmitting device using a communications module; transmitting an alert signal of the security event using the communications module and a communications system; receiving the alert signal using a remotely located computer system outside the specified area; sending data to the communications module using the computer system via the communications system; and communicating an alarm signal using the computer system after receiving the alert signal.

BRIEF DESCRIPTION OF THE DRAWINGS

These and other objects, features and advantages of the present invention will become apparent from the following detailed description of illustrative embodiments thereof, which is to be read in connection with the accompanying drawing, in which:

The FIGURE is a block diagram depicting a security system according to an embodiment of the present invention including sensors connected to communications modules for transmitting alert signals to a remote computer system.

DETAILED DESCRIPTION OF THE INVENTION

An illustrative embodiment of a security system and method 10 includes sensors 14 for detecting a security event and monitoring specified areas 20 as shown in one embodiment of the invention in the FIGURE. The security event may include an emergency event, e.g., a fire, flood, or burglary which may include detection of designated sounds, glass break, or entrance into a specified area. Further, the sensors 14 included in the system 10 may include, smoke detectors, fire detectors, motion detectors and/or infrared (PIR) detectors indicating a burglary attempt. In the embodiment of the invention shown in the FIGURE, the sensors 14 are grouped in the specified areas 20, however, alternatively, the sensors may be individually positioned in one or more areas, building, or floors of a building or located throughout a campus. The sensors 14 communicate with an expander module 24 which allows for expansion or scalability of the security system to interface with multiple sensors and multiple types or kinds of sensors. Additionally, another module 28 may be used for additional security devices such as access control, e.g., via a door as a secure point of entry, audio detection, or video monitoring. The sensors 14 and expander modules 24 transmit data along a data bus 30 to communications modules 40, 42, 44. User interfaces 34 are also connected to the data bus 30 and may include a keypad, and/or a keyboard and display. The communications modules 40, 42, 44 are embodiments of different communication devices. The communication modules 40, 42, 44 are connected to the data bus 30 and each includes a transmitting device, or, for example, transceiving devices 40*a*, 42*a*, 44*a*, respectively. The transceiving devices 40*a*, 42*a*, 44*a* can transmit and receive signals, to and from a remotely located computer system 60, i.e., outside the specified area 20. The signals include data signals including, for example, control data, supervision messages, battery monitoring data, main power monitoring data, device malfunction data (e.g., a sensor), as well as, keypad data. Additionally, the transceiving devices 40*a*, 42*a*, 44*a* communicate with the sensors 14 and transmit an alert signal 50 indicating a security or emergency event to the computer system 60. Additionally, data from the keypads is sent to the computer system 60 via the communications modules 40, 42, 44, for authentication of an entered keycode. The computer system 60 may be, for example, a server with peripheral devices such as a monitor, external hard drives, or a network of servers. The computer system 60 includes a computer program 62 saved in a data storage device 64 and a microprocessor 66 for executing the computer program 62.

Other communication modes and alternative system components and the like may be employed in the security system. For example, as shown in commonly-owned, and co-pending U.S. patent application Ser. No. (12/015,679), the entire contents and disclosure of which is expressly incorporated by reference herein in its entirety.

More specifically, the communications modules 40, 42, 44, use different modes of communication and offer redundancy of the transmission of alert signals, e.g., if one mode fails, the alert signal would reach the computer system 60 using another mode of communication from another communications module. The redundant communications can be sent, for example, simultaneously or upon failure of one or more of the communication modules. Many modes or types of communication may be used in the communications module, in the embodiment of the invention shown in the FIGURE, one communication module 40 uses, for example, Ethernet standards or protocols on a computer network using the Internet, another communication module 42 uses, for example, the public switched telephone network (PSTN), and another communication module 44 uses, for example, General Packet Radio Service (GPRS) which is a mobile data service using Global System for Mobile Communications (GSM). The remotely located computer system 60 monitors and responses to the communications of the transmitting devices of the communications modules 40, 42, 44 which monitor and respond to the sensor devices 14. The computer system 60 communicates an alarm signal 70, for example, upon receiving an alert signal 50, or after an analysis of the type and/or frequency of the alert signal 50. The computer system 60 may also have multiple microprocessor and other back up systems or have a back up for the entire computer system 60. The computer system 60 may be located at a monitoring station or a central station, and/or send alarm signals to portable or hand held device, such as cellular telephones, as well as emergency personnel. Further, the remote computer system 60 may activate a local alarm signal, such as a siren and/or visual indicator in response to receiving an alert signal from a sensor 14. Alternatively, the sensors 14 and actuators may be directly connected to a communications module 40, 42, 44, instead of being connected to an expander module.

Additionally, the computer system 60 may monitor a plurality of separate security systems which may belong to different customers. The computer system logically separates each of the security systems, thereby functioning or performing like separate control panels. Additionally, the sensors may be grouped into zones defined by the type of detection, including, for example, security zones, maintenance zones, or detection zones, and in further avatars, all smoke detectors may be in one zone and motion detectors in another zone.

The computer system may also remotely update software and/or firmware in communications modules 40, 42, 44 at one or more locations and for multiple systems, by sending a data transmission 54 from the computer system 60 to the communications modules 40, 42, 44. Thereby, centralized installation and upgrades of the computer system replaces the on-site control panel in current security systems, rendering technician visits to the site unnecessary in many instances.

A further advantage of the security system of the present invention is that the computer system requirements include software and peripheral devices which are less expensive than an on site control panel. The costs savings applies to, for example, installation costs, e.g., unit cost and labor time, and upgrades, as well as, the cost saving of stocking and supply the software and peripheral devices as compared to control panels in conventional security systems.

Moreover, the computer system 60 includes a computer program 62 embodied on a computer readable medium, e.g., the data storage device 64 and executable by a microprocessor 66 in the computer system 60. In one embodiment of the invention, the computer program 62 logically generates a plurality of control devices or control panels, or divides the sensors being monitored into logical security zones. The control panels as well as the security zones may be graphically represented on a graphical user interface (GUI) 68, or for example, textually represented and printed. The communications modules and the computer system may also utilize encryption technology for sending and receiving signals.

While the present invention has been particularly shown and described with respect to preferred embodiments thereof, it will be understood by those skilled in the art that changes in forms and details may be made without departing from the spirit and scope of the present application. It is therefore intended that the present invention not be limited to the exact forms and details described and illustrated herein, but falls within the scope of the appended claims.

What is claimed is:

1. A security system, comprising:

at least one sensor for detecting a predetermined security event in a defined area;

at least one communications module including a transmitting device, the communications module communicating with the sensor and the transmitting device transmitting an alert signal of the security event using a communications system; and a remotely located computer system outside the defined area, the computer system communicating with the communications module using the communications system, the computer system controlling the communications between the transmitting device of the communications module and the computer system for receiving transmissions from and sending transmissions to the communications module, the computer system communicating an alarm signal after receiving the alert signal, and the computer system sending a data transmission directly to the communications module to remotely update software and/or firmware in the communications module, absent an intermediary control panel in the defined area.

2. The system of claim 1, wherein the computer system communicates with multiple communication systems for communicating with associated communication modules.

3. The system of claim 1, wherein the computer system communicates with multiple communication systems for receiving the alert signal from the communications module and for transmitting to the communications module.

4. The system of claim 1, wherein the computer system communicates simultaneously with multiple communication systems for receiving the alert signal from associated communication modules using each of the multiple communication paths, and the computer system uses each of the multiple communication systems for transmitting to each of the associated communication modules.

5. The system of claim 1, wherein the communication module communicates with a plurality of detection areas and each detection area includes a plurality of sensor devices.

6. The system of claim 1, wherein the computer system includes a computer program embodied on computer readable medium executable by a microprocessor in the computer system, and the computer program logically generates security zones, and each security zone includes a plurality of associated sensor devices.

7. The system of claim 6, wherein the computer system presents a graphic interface on a GUI interface wherein the graphic interface presents representation for each of the security zones.

8. The system of claim 1, further including multiple communication modules.

9. The system of claim 8, wherein the multiple communication modules each connect to a data bus communicating with security areas including multiple sensors.

10. The system of claim 1, wherein the alert signal is wirelessly transmitted.

11. The system of claim 1, wherein the transmission of the alert signal is encrypted.

12. The system of claim 1, wherein the computer system is located in a remotely located monitoring station.

13. A method for securing a specified area, comprising:

detecting a predetermined security event using a sensor in a specified area;

communicating with the sensor and a transmitting device using a communications module;

transmitting an alert signal of the security event using the communications module and a communications system;

receiving the alert signal using a remotely located computer system outside the specified area;

sending data to the communications module using the computer system via the communications system;

communicating an alarm signal using the computer system after receiving the alert signal; and the computer system sending a data transmission directly to the communications module to remotely update software and/or firmware in the communications module, absent an intermediary control panel in the specified area.

14. The method of claim 13, further including:

communicating simultaneously with multiple communication systems using the computer system.

15. The method of claim 13, further including:

generating logically a plurality of security zones each associated with a plurality of sensor devices using the computer system.

16. The method of claim 15, further including:

presenting a graphic interface on a GUI interface wherein the graphic interface presents representation for each of a plurality of security zones.

17. A computer program product comprising a non-transitory computer readable medium having recorded thereon a computer program for enabling a processor in a computer system for securing a specified area, the computer program performing the steps of:

detecting a predetermined security event using a sensor in a specified area;

communicating with the sensor and a transmitting device using a communications module;

transmitting an alert signal of the security event using the communications module and a communications system;

receiving the alert signal using a remotely located computer system outside the specified area;

sending data to the communications module using the computer system via the communications system;

communicating an alarm signal using the computer system after receiving the alert signal; and the computer system sending a data transmission directly to the communications module to remotely update software and/or firmware in the communications module, absent an intermediary control panel in the specified area.

* * * * *